United States Patent [19]

Kröcher et al.

[11] Patent Number: 4,562,873

[45] Date of Patent: Jan. 7, 1986

[54] METHOD OF AND ARRANGEMENT FOR MILLING ROOT BUTTS OF ROUND TIMBER

[75] Inventors: Harro Kröcher; Dieter Krautzenberger, both of Bad Kreuznach; Hans Sybertz, Hargesheim; Uwe Becker, Friedberg, all of Fed. Rep. of Germany

[73] Assignee: Hombak Maschinenfabrik GmbH & Co. KG., Bad Kreuznach, Fed. Rep. of Germany

[21] Appl. No.: 584,095

[22] Filed: Feb. 27, 1984

[30] Foreign Application Priority Data

Feb. 25, 1983 [DE] Fed. Rep. of Germany ..... 3306569
Sep. 20, 1983 [DE] Fed. Rep. of Germany ..... 3333910

[51] Int. Cl.[4] ..... B27B 1/00

[52] U.S. Cl. ..... 144/356; 144/2 R; 144/208 G; 144/363; 144/4

[58] Field of Search ..... 144/2 R, 4, 208 R, 208 G, 144/356, 357, 363, 208 E

[56] References Cited

U.S. PATENT DOCUMENTS

| | | | |
|---|---|---|---|
| 2,646,092 | 7/1953 | Kolpe et al. | 144/208 E |
| 2,725,908 | 12/1955 | Ednell et al. | 144/208 E |
| 2,767,750 | 10/1956 | Stewart | 144/208 E |
| 3,789,893 | 2/1974 | Carson et al. | 144/208 E |
| 3,913,644 | 10/1975 | Braun | 144/208 E |
| 4,303,111 | 12/1981 | Neville | 144/2 R |

*Primary Examiner*—W. D. Bray
*Attorney, Agent, or Firm*—Michael J. Striker

[57] ABSTRACT

For milling root butts on round timber, a trunk is clamped at a predetermined location and non-rotatable, a milling shaft with a milling tool is brought into abutment against the trunk, the milling tool mills in the trunk butt in the abutment region to a predetermined radial depth, then by a rotary device it is moved around the trunk and mills the root butt over the entire trunk periphery with controlling of the respective radial depth of the milling shaft by a sensor arranged to sense the outer surface of the trunk.

20 Claims, 11 Drawing Figures

(II-II)

V
V
IV
IV
17
18
16
5
24
3a
21
2
38
13
3
15
20
2a
25
2
2a
28
18
13
d
21
2
3
3a
6
2a
24
a
5
25
24
2
2a

METHOD OF AND ARRANGEMENT FOR MILLING ROOT BUTTS OF ROUND TIMBER

BACKGROUND OF THE INVENTION

The present invention relates to a method of and an arrangement for milling root butts of round timber, wherein a rotatable milling tool mounted on a milling shaft is brought into abutment against a trunk to be worked by an adjusting device, and then the root butt is milled out by relative rotary movement between the trunk and the milling tool to a desired trunk diameter.

Root butts interfere with working of round timber. This is true, for example, for transportation on elongated conveying devices in which the root trunks are hooked and block the transportation. This is also true for round timber storage in sorting boxes in which rumbling trunks are located in inclined position and often slide so that they engage with the trunks in the subsequent boxes, whereby the boxes emptying with stapler or crane became very difficult. Further disturbances involve plank impacts on railings, fixedly running circular saws, difficult cut guidance in the event of blocked band saws, etc. Straightening of the trunks involves considerable time and especially when a root butt has been clamped and must be released with great efforts by a hand saw and hand spike.

There are automatically operating root reducers which mill the root butts to the shaft diameter provided by the trunk. The known arrangements of this type operate in accordance with the following principle: The trunk to be worked is placed on a V-shaped block provided with driving roller chains. The trunk is loaded from above by a hold-down element which is also provided for supporting the rotation of the trunk with a driving roller chain or with a driving pressing wheel pressed against the outer surface of the trunk. During rotation of the trunk about its longitudinal axis, a milling tool is moved laterally from above parallel to the axis of the trunk and progressively mills the root butt. The milling tool can be mounted in a support which is hydraulically liftable and lowerable. Thereby the milling depth can be changed and adjusted as needed. The arrangement of the milling tool and the position of the supporting block guarantee that all trunks are reduced, regardless of their root diameter, parallel to the line of alignment of their outer surface.

All known arrangements are based on the principle of a relative movement between the trunk and the milling tool obtained by rotation of the trunk around its longitudinal axis, whereas the milling tool during the milling step is retained stationarily. The disadvantage of this principle is the construction expenses required particularly for the long trunks to drive them in rotation. The further disadvantage is that the milling tool which engages laterally from above the trunk during the milling process applies forces which try to press it upwardly. Thereby a non-even abutment of the trunk takes place, which reduces the service life of the milling tool. Finally, it is not possible with the fixedly held milling tools during milling to provide working corresponding to the heavily bent trunk ends deviating from the longitudinal axis of the trunk. This leads to a non-uniform milling process. The arrangements of the above general type are disclosed in prospectuses and partially in the German Offenlegungsschrift DE-OS 2,847,353.

SUMMARY OF THE INVENTION

Accordingly, it is an object of the present invention to provide a method of and an arrangement for milling root butts, which avoid the disadvantages of the prior art.

More particularly, it is an object of the present invention to provide a method of and an arragement for milling root trunks, which allow individual orientation to the respective shape of the trunk ends to be worked.

In keeping with these objects and with others which will become apparent hereinafter, one feature of the present invention resides, briefly stated, in a method in accordance with which a trunk is held at a predetermined non-rotatable location, the outer surface of the trunk is sensed at least at one point beyond the region of the root butts, at least one milling tool is brought into abutment against the trunk and mills the latter in the abutment region in the root butt until it produces a radial depth detected and fixed by the above mentioned sensing, and starting from the thus obtained radial depth the further rotating milling tool is moved around the immovable trunk and controlled in its respective radial depth by the simultaneously conducted sensing of the respective outer surface contour of the trunk.

In accordance with the present invention, the trunk is retained immovable, whereas the milling tool is rotated around the trunk, and its radial distance from the longitudinal axis of the trunk is controlled by a sensor or the like also rotating around the trunk. The reference value for the control of the milling tool is not the trunk axis, but instead the outer surface of the trunk. Thereby an individual adaptation of the respective milling is guaranteed, even in the event of, for example, heavily bent trunk ends.

It is advantageous when in the novel method and trunk is retained immovable, since the expenses for rotation of very long trunks can be dispensed with.

Since a cutting tool can bring about a predetermined cutting output with a predetermined feed, it is advantageous for utilization of the respective optimal cutting output to increase the angular velocity with which the milling tool is rotated around the trunk with the reduction of the trunk diameter.

In the inventive arrangement this object is attained when a rotary device is rotatable around an axis of the trunk and carries the milling tool with its adjusting device, which is controlled by a sensor swingable or displaceable to abutment against the outer surface of the trunk.

The German Offenlegungsschrift DE-OS No. 3,026,580 discloses a machine for milling trunk timber on the end surfaces. Machines of this type are used when during production of piles, wooden supports, masts and the like, chamfers at the edges of the end surfaces must be provided. In this arrangement the trunk is clamped immovably. An edge miller for the production of the chamfers is arranged together with its motor drive on a swinging arm which is articulately connected with a swinging axle on a shaft transverse to the axis of the trunk, whereas the shaft is supported rotatably coaxially to a hypothetical axis of the trunk and provided with a motor drive. Thereby the edge miller is movable around the above mentioned axis radially to the axis of the trunk timber and through the axis of the above mentioned shaft around the trunk. The above mentioned shaft is also displaceable axially. The above mentioned swinging arm is supported with its free end via a roller on the outer surface of the trunk, whereas the swinging arm with its supporting roller is pulled under the action of a spring against the outer surface of the trunk. Thereby the edge miller exactly follows the peripheral contour of the trunk on the end surface and can make a constantly wide chamfering. This construction cannot be transferred directly to a known root reducer, since the edge miller cannot be replaced directly by a cylindrical milling tool. Moreover, with the kinemtatic principle of swinging the above mentioned turning arm against the trunk, the milling tool first comes to abutment against the root butt without providing a contact of the supporting wheel with the outer surface of the trunk.

It is advantageous when, in accordance with the present invention, the rotary device includes a rotatably supported rotary mount, whose inner diameter is greater than the maximum possible diameter of the clamped trunk and whose axis of rotation is approximately in alignment with the axis of the clamped trunk.

The adjusting device for the milling tool is advantageous when the milling tool is supported between two swinging arms which are swingable by a drive and fixed on a shaft which is pivoted eccentrically and floatingly at the rotary mount parallel to its axis.

The drive for the swinging arms can be formed as a hydraulically or pneumatically operated piston whose control is influenced by the sensor. The sensor advantageously includes a sensing arm with a free end forming the abutment surface for the outer surface of the trunk, whereas the other arm end seats in a rotary-fixed manner on a copying shaft which acts upon a control device for the drive of adjusting means of the milling shaft.

In accordance with the present invention, a holding-down element can be provided centrally between the supports which form a base and rotation-securing means. Particularly in the case of thin trunks, it is advantageous when the holding-down element engages the trunk nearly the support facing toward the rotary mount to prevent bending of the trunk. When in accordance with the present invention the inner diameter of the rotary mount is greater than the maximum possible diameter of the clamped trunk, thus the supply or withdrawal of the trunk can be performed through the rotary mount.

Tree trunks have at their root butt mainly a cutting surface inclined to their axis, inasmuch as during falling of the trees they are separated mainly by a wedge-shaped cut from their root part. Prior to the further cutting of the trunk into beams, boards or the like, conventionally a rectangular top cut of this root butt is required, inasmuch as otherwise no exact board or beam length can be cut. These so-called clean-cuts have been conducted in a separate working step. For this purpose a transverse conveyor is required which must be provided for different working steps and equipped with separate top saw, that involves high machine expenses and space requirement.

To further improve the inventive root reducer in regard to its individual adaptation to the respective shape of the trunk end to be worked, it is advantageous when the milling tool in its region facing toward the rotary mount is equipped with a circular saw blade and/or a milling disk whose radius is at least as great as the radial distance between the axis of rotation of the rotary device and the milling tool rotary axis, when the latter assumes its end position corresponding to the maximum trunk diameter.

Thereby the clean cut is simultaneously performed with the milling of the root butt. Thereby the machine expenses, the mounting area and the required manipulations are reduced.

A milling disk can be provided when the trunk end separated by the clean cut must be cut without residues, so that no disks take place. The main disk can be provided additionally with a circular saw blade. The latter can, however, be replaced by a respectively wide milling disk.

The circular saw blade and/or milling disk can be arranged at a certain distance from the inner respectively rear end of the milling shaft. A disk of the milling tool can be replaced by the circular saw blade and/or the milling disk.

The largest required diameter of the circular saw blade and/or the milling disk determined by the distance between the axis of rotation of the rotary device and the axis of the milling tool is obtained when, in the arrangement, the wood trunk is worked with the maximum possible diameter and the milling shaft during milling of the root butt assumes its end position, in which it is located at the smallest radial distance from the axis of rotation of the rotary means during the working process.

In some application cases, it is advantageous when working of vertically extending trunks takes place. In this case it is advantageous when the rotary mount is composed of a horseshoe-shaped circular segment with a trunk inlet opening with an arc of less than 180° and rotatably supported in a horizontal plane of a frame. The frame is also horseshoe-shaped and is displaceably vertically arranged in a guiding device and acted upon by a lifting and lowering device. The guiding device is advantageously mounted on a carrying device which is tiltable by a swinging drive about a horizontal axis. It is advantageous when the carrying device is mounted with its pivot axle on a vehicle. The mounting can be performed from the front side or the rear side of the vehicle, so that a mobile root reducer is produced which can work on trunk ends located in the ground.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
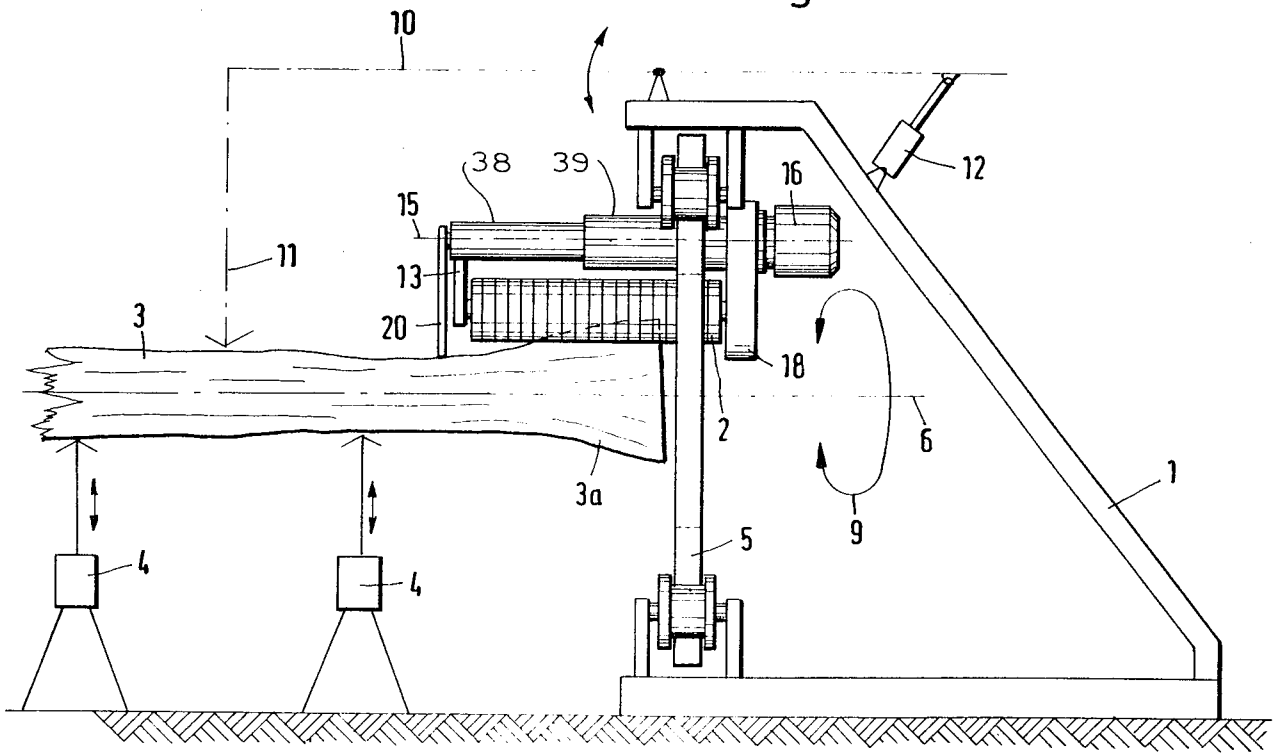
FIG. 1 is a side view schematically showing a root reducer with a clamped tree trunk.

FIG. 1 shows a root reducer which includes a frame 1 with a milling tool 2, and a base for receiving a clamped trunk 3 and illustrated schematically in form of two supports 4. The trunk 3 is so supported on the base that its root butt 3*a* is located near the frame 1 and in the region of the milling tool 2.

Figure 3:
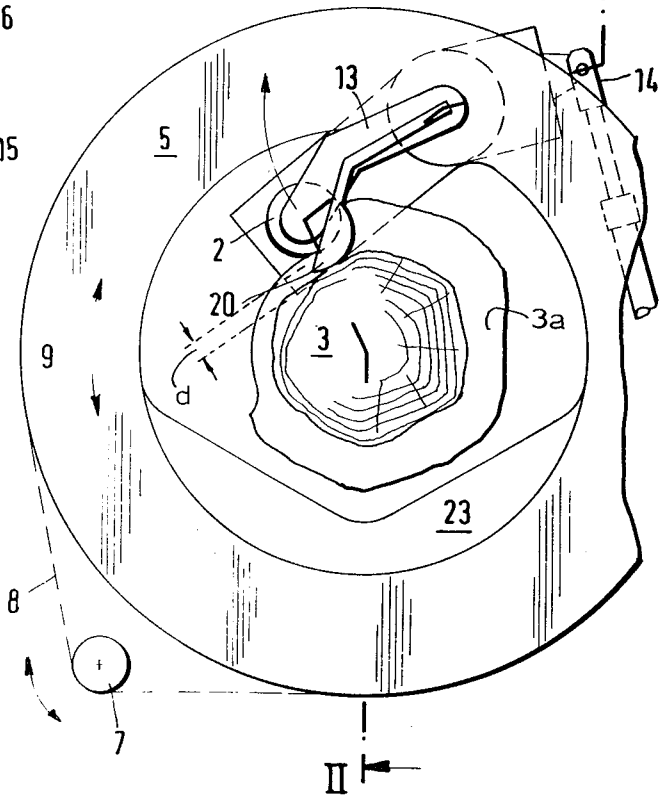
FIG. 3 is a side view of the root reducer of FIG. 2.
Figure 2:
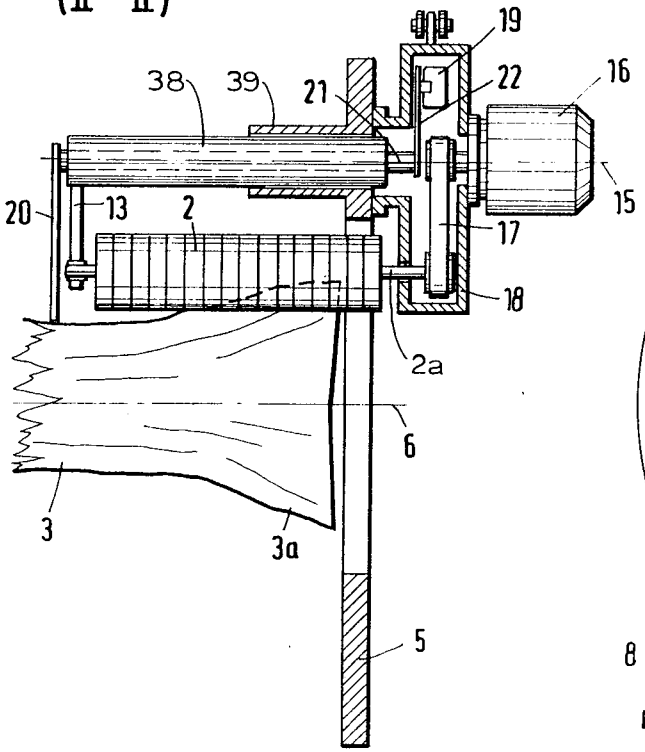
FIG. 2 is a view showing a partially sectioned fragment of FIG. 1 on an enlarged scale in longitudinal sectional view along the line II—II of FIG. 3.

A rotary mount 5 is rotatably supported in the frame 1 in a vertical plane extending normal to the base. The inner diameter of the rotary mount 5 is considerably greater than the maximum possible diameter of the trunk to be worked. The rotary mount 5 has an axis of rotation 6 which must be in alignment with the hypothetical axis of the trunk 3. For guaranteeing this for each diameter of the trunk, the supports 4 are height-adjustable. FIG. 3 shows a drive 7 for the rotary mount 5. The drive 7 is arranged to drive the rotary mount 5 via a chain 8 alternately by a full revolution in one rotary direction and then in the other rotary direction, as indicated by arrows 9 in FIGS. 1 and 3.

As shown in dash-dot lines in FIG. 1, a beam 10 is swingable supported on the frame 1 and has an end which extends outwardly beyond the milling tool 2 and is provided with a holding-down element 11 which loads the clamped trunk 3 from above. The holding-down element 11 engages the trunk substantially centrally between both supports 4. The swingable of the beam 10 is carried out via a piston drive 12.

The milling tool 2 is supported between two swinging arms 13 and 18 which are turnable by a piston drive 14 shown in FIG. 3 about an axis 15. For this purpose the swinging arms 13 and 18 are fixed on a shaft 38 which is floatingly pivoted in a bearing bush 39 on the rotary mount 5 parallel to the axis of rotation 6 of the latter.

The drive motor 16 for the milling tool 2 is connected with the milling unit in the region of the swinging arm 18, and its motor shaft is in alignment with the swinging axis 15 of the swinging arms 13 and 18. A force-transmitting element 17 between the motor shaft and the milling tool 2 is arranged in the inner hollow turning arm 18.

A control device 19 actuated by a sensor 20 is provided for the piston drive 14 of positioning the milling tool 2 for abutment against the trunk 3. The sensor is formed as a sensing arm 20 whose free end forms an abutment surface for the outer surface of the trunk 3, whereas the other arm end is fixedly connected for joint rotation with a shaft 21 which is arranged concentrically to the axis of swinging 15 and is free turnably pivoted within the shaft 38. The shaft 21 carries at its inner end a control lever 22 actuating the control device 19. The sensing arm 20 lies immediately near the outer swinging arm 13.

The rotary mount is provided with a counterweight 23 compensating for the weight of its structural elements.

The above described root reducer operates in the following manner:

A trunk 3 is placed from above, for example onto the supports 4 which are open in a V-shaped manner. It is placed such that its root butt 3*a* lies near the rotary mount 5. At this point the swinging arms 13 and 18 which carry the milling tool 2 are swung outwardly together with the sensing arm 20 onto the rotary mount 5. By lifting or lowering of the support 4 the trunk 3 is so directed that its hypothetical axis at least approximately coincides with the axis of rotation 6 of the rotary mount 5. By actuation of the piston drive 12, the beam 10 is swing downwardly until the holding-down element 11 abuts against the trunk 3 and presses the same in a rotary-fixed manner into its supports 4. After the trunk is placed accurately, the sensor arm 20 is swung manually relative to the trunk 3 till it abuts the outer surface of the trunk. This actuates by swinging of the shaft 21 and swinging of the control lever 22 a respective action of the control device 19, which for example opens a supply valve to the cylinder of the piston drive 14. The piston of the piston drive 14 extends and swings, via the swinging arms 13 and 18, the milling tool 2, which after being driven in rotation by starting the drive motor 16 abuts then against the root butt 3*a* and begins milling in the root butt 3*a* at the abutment location. The following control of the milling tool 2 via the sensing arm 20 can be performed so that the milling tool 2 in its end position relative to the axis of rotation 6 has always a radial distance which is somewhat greater by amount "d" than the free end of the sensing arm 20. In this case the milling tool 2 with consideration of the position of the sensing arm 20 shown in FIG. 3, mills into the root butt 3*a* so far until the milling tool 2 assumes the position shown in FIG. 3. After this, the drive 7 starts and rotates the rotary mount 5, as shown in FIG. 3, for example in clockwise direction by one full revolution, during which the milling tool 2 taken along by the rotary mount 5 mills the root butt 3*a* over the entire periphery of the trunk 3. In this one revolution of the rotary mount 5, the radial distance provided between the milling tool 2 at the beginning of rotation of the rotary mount 5 from its axis of rotation 6 is controlled in dependence upon the outer surface of the trunk sensed by the sensing arm 20. As mentioned above, the milling tool 2 maintains always a somewhat greater radial distance from the axis of rotation 6 than the free end of the sensing arm 20. After complete termination of one full revolution of the rotary mount 5, the device 7 is turned off e.g. by an end switch, the rotary mount 5 stops, the milling tool 2 is again swung radially outwardly to its initial position, the sensing arm 20 is also swung back, by withdrawal of the piston of the piston drive 12 the holding-down element 11 is lifted, the trunk 3 is removed from its support 4, and a new trunk can be placed on the support. During the subsequent working of the new trunk 3, the above mentioned working steps are repeated, however the drive 7 rotates the rotary mount 5 now in a counterclockwise direction by a full revolution.

Figures 4, 5, 6, 7:
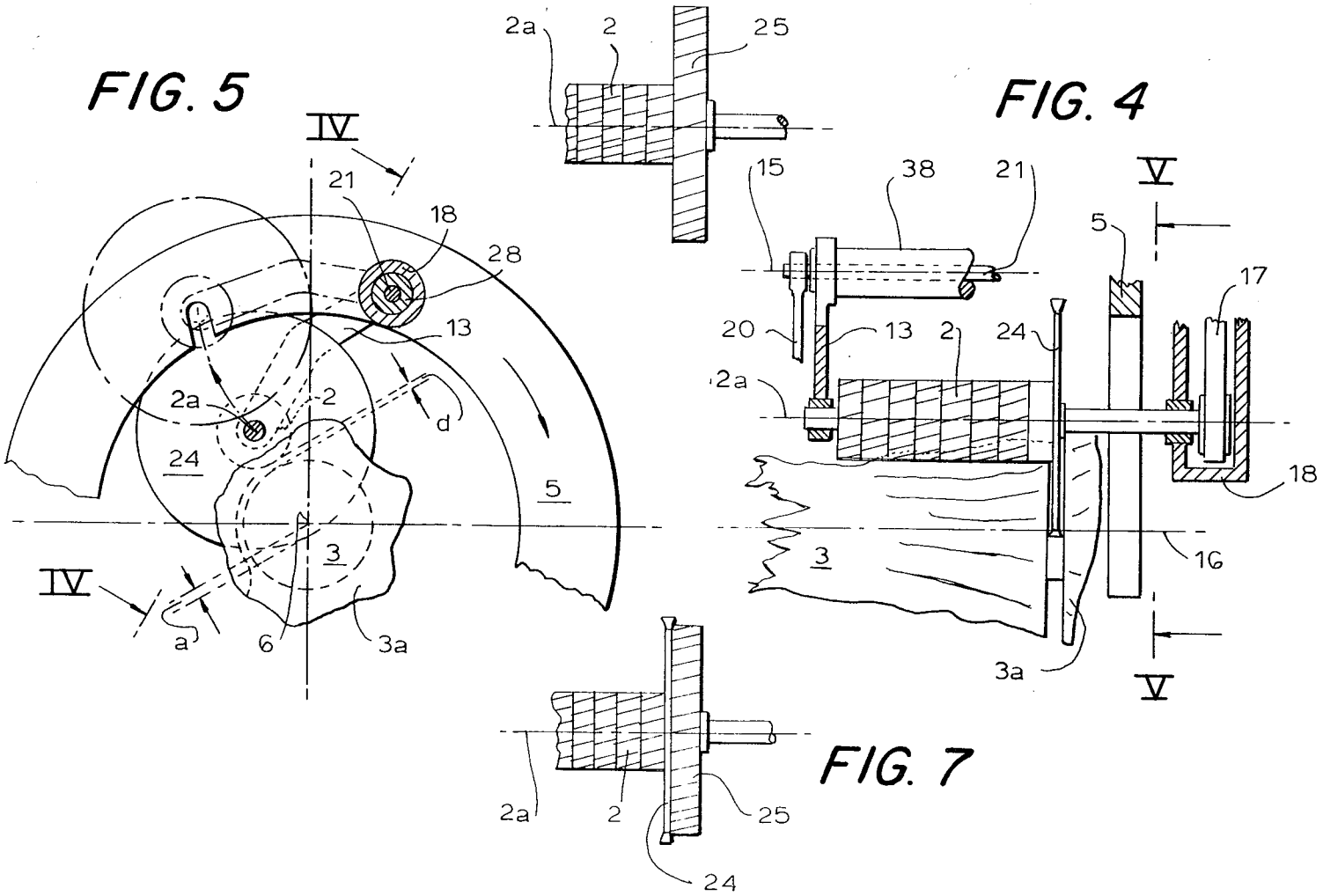
FIG. 4 is a sectional view along the line IV—IV of FIG. 5 schematically showing a milling shaft provided with a circular saw blade.
FIG. 5 is an end view of the milling tool from the line V—V of FIG. 4 in the working position on a tree trunk.
FIG. 6 is a view showing a fragment of FIG. 4, in accordance with another embodiment of the present invention.
FIG. 7 is a view showing an embodiment which differs from the embodiment of FIG. 6.

The milling tool 2 shown in FIG. 4 is provided in its region facing toward the rotary mount 5 with a circular saw blade 24 whose radius is somewhat greater than the maximum radial distance of the axis 2*a* of the milling tool from the axis 6 of the rotary mount 5. The thus produced overlapping is identified in FIG. 5 with reference character "a".

In FIG. 6, instead of the circular saw blade 24, a milling disk 25 is provided. In FIG. 7, it is arranged additionally to the circular saw blade 24. In the embodiments shown in FIGS. 5–7, not only circumference milling of the root trunk is performed, but also a cleaning cut is carried out. With the arrangement of a circular saw blade 24, and/or a milling disk 25 in the embodiment shown in FIG. 1, the sixth rear disk of the milling tool 2 can for example be replaced by the circular saw blade 24 or the milling disk 25.

Figure 9:
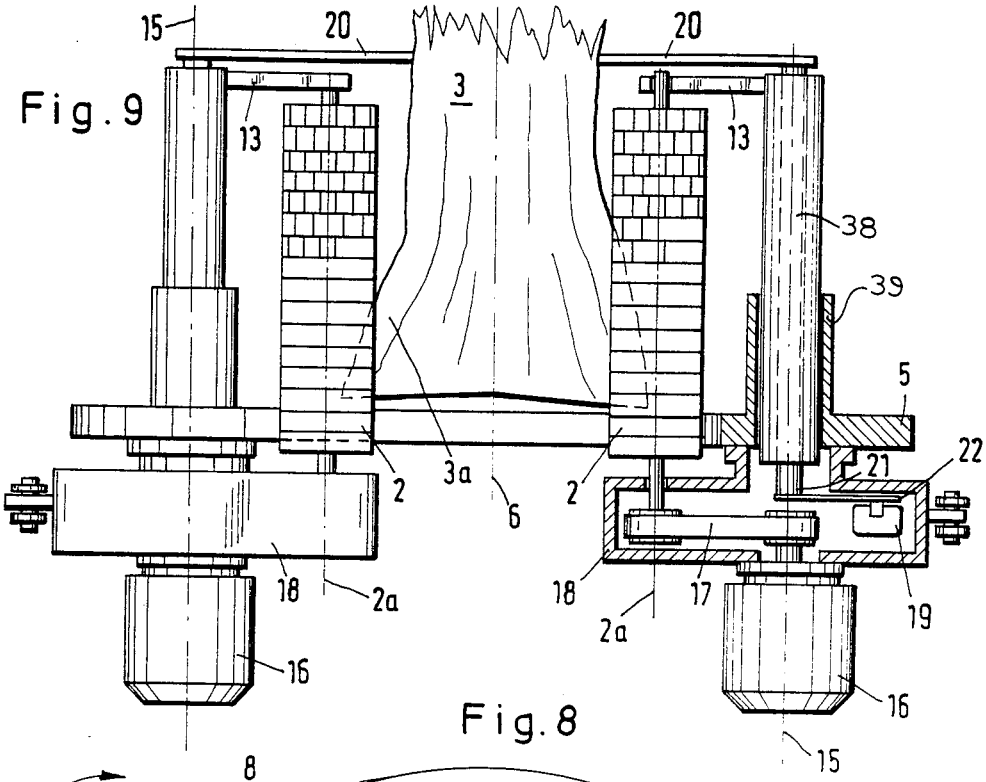
FIG. 9 is a view showing a section taken along the line IX—IX in FIG. 8.
Figure 8:
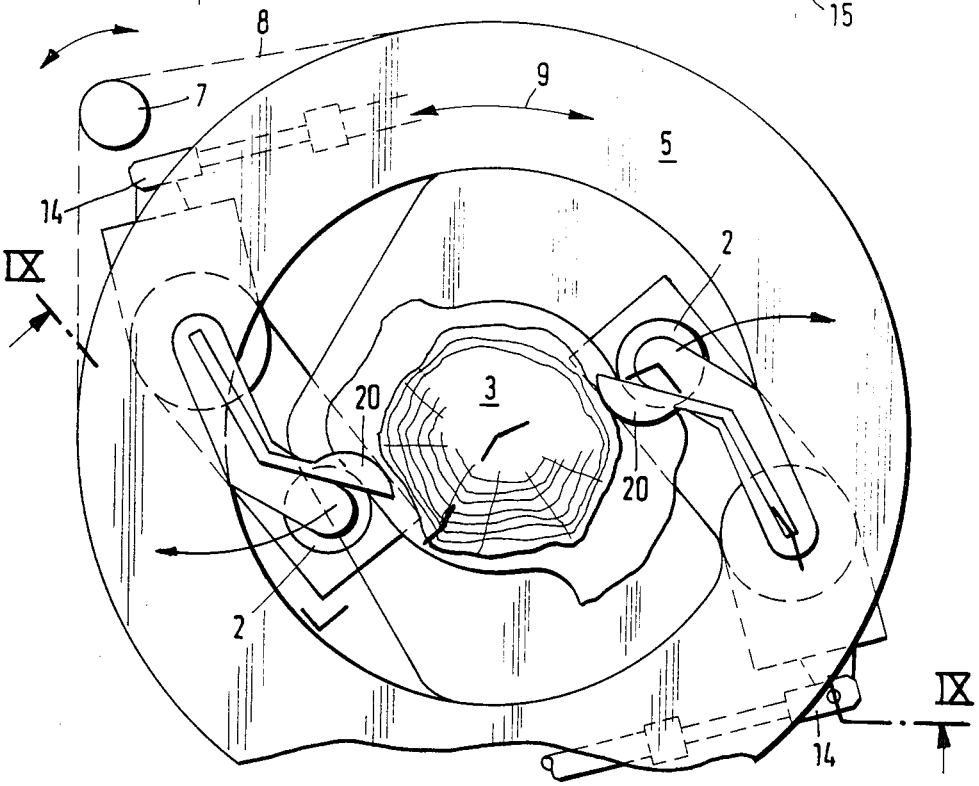
FIG. 8 is an end view of the arrangement provided with two milling tools in accordance with FIG. 3.

In FIGS. 8 and 9 there is shown a root reducer with the rotary mount 5 which is provided with two milling tools 2. The milling tools 2 are offset relative to one another by 180°. The drive 7 drives the rotary mount 5 alternately first by a half revolution in one rotary direction, and then in the other rotary direction 9.

Figure 10:
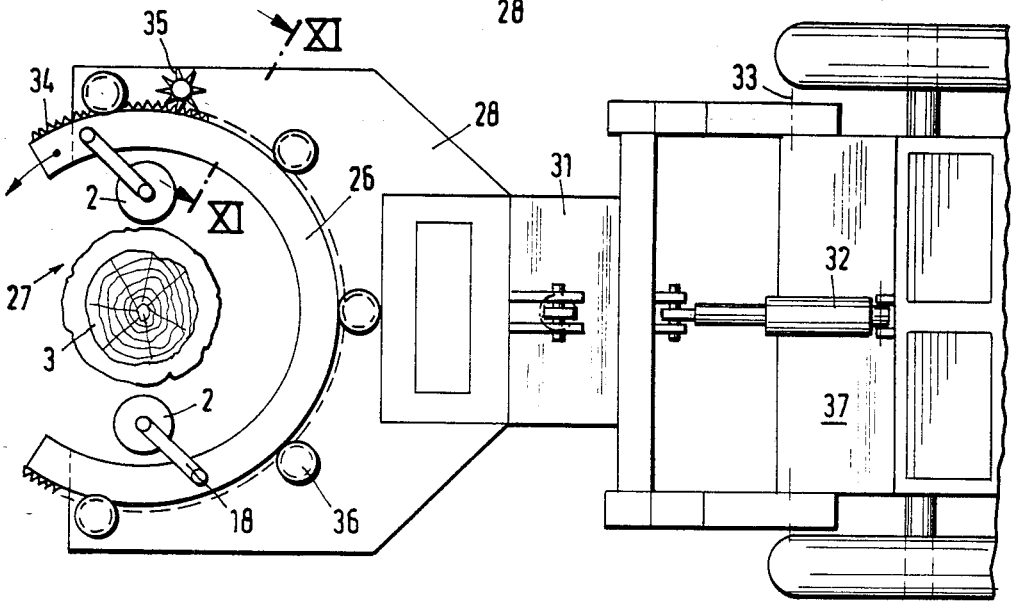
FIG. 10 is a plan view of a mobile root reducer.
Figure 12:
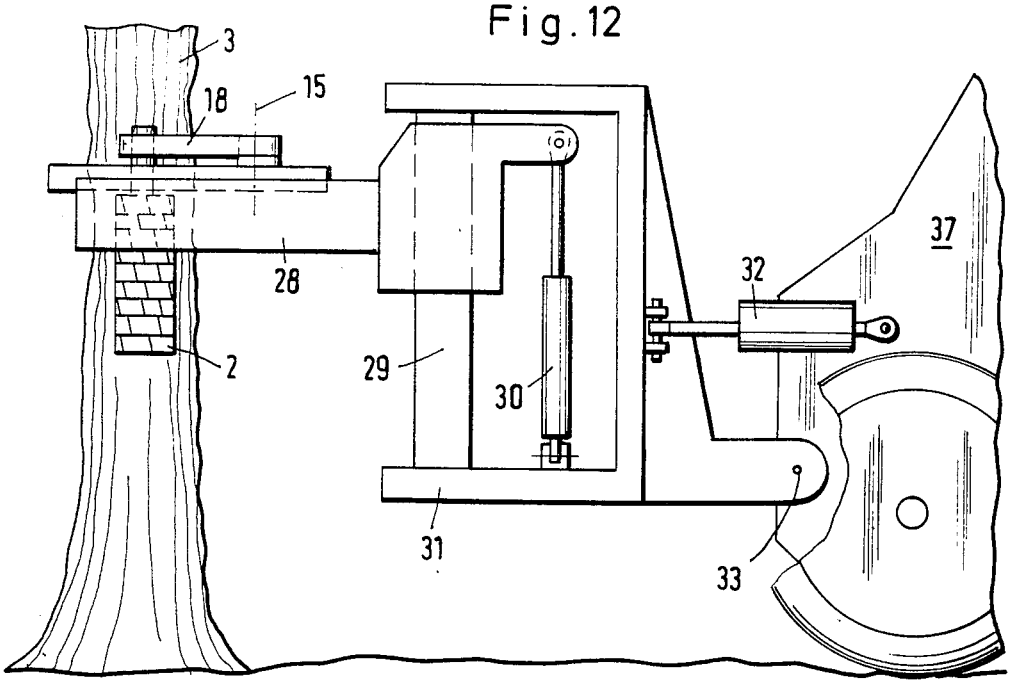
FIG. 12 is a side view of the mobile root reducer of FIG. 10.

FIGS. 10 and 12 show a mobile root reducer in which the rotary mount 26 is formed by a horseshoe-shaped circular segment. It is provided with a trunk inlet opening 27 with an arc of less than 180° and is rotatably supported inside a horizontal plane in a frame 28. The frame 28 in turn is also horseshoe-shaped and is supported vertically displaceable in a guiding device 29 and actuated by a lifting and lowering device 30 which can be formed as a lifting piston. The guiding device 29 is mounted on a carrying device 31 which is tiltable by a swinging drive 32 about a horizontal axle 33.

Figure 11:
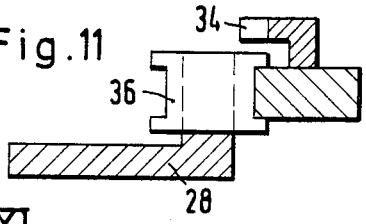
FIG. 11 is a view showing a section taken along the line XI—XI in FIG. 10, on an enlarged scale.

As can be seen from FIGS. 10 and 11, the rotary mount 26 is provided with a toothed rim 34 which engages with a driving pinion 35. Moreover, the rotary mount 26 is supported in guiding rolls 36 which engage the rotary mount 26 from above and from below. For providing a mobile arrangement, the carrying device 31 is mounted by its pivot axle 33 on a vehicle 37.

It will be understood that each of the elements described above, or two or more together, may also find a useful application in other types of constructions differing from the types described above.

While the invention has been illustrated and described as embodied in an arrangement for milling root butts of round timber, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A method of milling root butts of round timber comprising the steps of holding a trunk in a fixed non-rotatable location; sensing an outer surface of the trunk at least at one point beyond the region of the root butts; displacing a milling tool to abutment against the trunk; milling the trunk by the milling tool in the abutment region of the root trunk until it reaches a radial depth obtained and fixed by said sensing; and moving the rotating milling tool, after attainment of said radial depth, around the trunk while simultaneously controlling of its respective radial depth by a simultaneously conducted sensing of the respective outer surface contour of the trunk.

2. A method as defined in claim 1, wherein said moving step includes increasing the angular velocity with which the milling tool is moved around the trunk with reduction of a trunk diameter.

3. An arrangement for milling root butts of round timber, comprising at least one rotary shaft arranged to carry a milling tool; adjusting means for moving said milling tool so that it abuts against a trunk; rotary means rotatable about a hypothetical axis of the trunk and supporting said milling tool with said adjusting means; and a sensor movable to abutment against an outer surface of the trunk and arranged to control said adjusting means and also supported by said rotary means.

4. An arrangement as defined in claim 3, wherein said rotary means includes a rotatably supported rotary mount with an inner diameter which is greater than a maximum diameter of the trunk and with an axis of rotation which is at least approximately in alignment with an axis of the trunk; and guiding rollers supporting said rotary mount.

5. An arrangement as defined in claim 4, wherein said adjusting means includes two swinging arms supporting said milling tool therebetween, and drive means arranged to swing said swinging arms about an axis by means of a shaft which is pivoted flyingly on said rotary mount parallel to its axis of rotation.

6. An arrangement as defined in claim 5, wherein said drive means has a fluid-actuated piston with a control device acted upon by said sensor.

7. An arrangement as defined in claim 5, wherein said adjusting means of said milling tool has a control device, said sensor having a sensing arm with a free end forming an abutting surface for an outer surface of the trunk, and another end seating on a shaft which acts upon said control device for the drive means of the adjusting means and which is pivoted concentrically within the shaft of the drive means.

8. An arrangement as defined in claim 5, and further comprising a drive motor provided for said milling shaft and arranged in the region of one of said swinging arms, said drive motor having a motor shaft which is in alignment with a swinging axis of said adjusting means, and a force-transmitting element between said motor shaft and said milling tool.

9. An arrangement as defined in claim 8, wherein said one swinging arm is hollow, said force-transmitting element between said motor shaft and said milling tool being arranged inside said inner hollow turning arm.

10. An arrangement as defined in claim 3, wherein said rotary means includes a rotary mount which supports only one said milling tool; and further comprising a drive for said rotary mount which alternately rotates said rotary mount by one full revolution in one rotary direction and then in the other rotary direction.

11. An arrangement as defined in claim 3, wherein said rotary means includes a rotary mount; and further comprising a second such milling shaft tool which is offset from said first milling tool by 180° C. and a drive for said rotary mount, said rotary mount supporting said two milling tools and being rotatable by said drive at least by one half revolution in one and then in the other rotary direction.

12. An arrangement as defined in claim 3; and further comprising two height-adjustable supporting elements which form a substantially horizontal base for receiving the trunk and movable substantially parallel to the axis of said milling tool, and a clamping device which holds the trunk on said supports so that its longitudinal axis at least approximately coincides with the axis of rotation of said rotary means.

13. An arrangement as defined in claim 12, wherein said clamping device comprises a frame, and a beam swingably supported on the frame and having a free end which extends beyond said milling tool and carries a holding-down element for loading from above the trunk and for preventing its rotation.

14. An arrangement as defined in claim 3, wherein said milling tool is provided in its region facing toward said rotary means with at least one tool whose radius is at least as great as a radial distance between the axis of rotation of said rotary means and the axis of rotation of said milling tool when the latter assumes its end position corresponding to a maximum possible diameter of the trunk.

15. An arrangement as defined in claim 14, wherein said tool arranged on the rotary shaft of the milling tool is a circular saw blade.

16. An arrangement as defined in claim 14, wherein said tool arranged on the rotary of the milling tool is a milling disk.

17. An arrangement as defined in claim 14, wherein said tool arranged on the rotary shaft of the milling tool is a circular saw blade and a milling disk.

18. An arrangement as defined in claim 3, wherein said rotary means includes a rotary mount composed of a horseshoe-shaped circular segment with a trunk receiving opening of an arc of less than 180°; and further comprising a frame likewise horseshoe-shaped and in which said rotary mount is rotatably mounted in a horizontal plane, guiding means for vertically guiding said frame, and lifting and lowering means acting upon said frame.

19. An arrangement as defined in claim 18; and further comprising carrying means on which said guiding means is mounted, and a swinging drive arranged to swing said carrying means about a horizontal axis; and further comprising a vehicle mounting said carrying means.

20. An arrangement as defined in claim 4, wherein said rotary mount is provided with a toothed rim engaging with a driving pinion.

* * * * *